US009662707B2

(12) United States Patent
Yoneda et al.

(10) Patent No.: US 9,662,707 B2
(45) Date of Patent: May 30, 2017

(54) PISTON CASTING METHOD AND PISTON CASTING DEVICE

(71) Applicant: HONDA FOUNDRY CO., LTD., Kawagoe-Shi, Saitama (JP)

(72) Inventors: Mitsuhiro Yoneda, Kawagoe (JP); Yasuo Urata, Kawagoe (JP); Tomoyuki Hirao, Kawagoe (JP); Masashi Mizuguchi, Kawagoe (JP)

(73) Assignee: Honda Foundry Co., Ltd., Saitama (JP)

( * ) Notice: Subject to any disclaimer, the term of this patent is extended or adjusted under 35 U.S.C. 154(b) by 0 days.

(21) Appl. No.: 15/021,844

(22) PCT Filed: Sep. 27, 2013

(86) PCT No.: PCT/JP2013/076360

§ 371 (c)(1),
(2) Date: Mar. 14, 2016

(87) PCT Pub. No.: WO2015/045121

PCT Pub. Date: Apr. 2, 2015

(65) Prior Publication Data

US 2016/0236272 A1 Aug. 18, 2016

(51) Int. Cl.

| | |
|---|---|
| ***B22D 15/02*** | (2006.01) |
| ***B22D 25/02*** | (2006.01) |
| ***B22C 9/06*** | (2006.01) |
| ***B22C 9/10*** | (2006.01) |
| ***B22C 9/24*** | (2006.01) |
| ***B22D 29/00*** | (2006.01) |
| ***B22D 30/00*** | (2006.01) |
| ***B22D 45/00*** | (2006.01) |

(52) U.S. Cl.

CPC ..... *B22D 15/02* (2013.01); *B22C 9/06* (2013.01); *B22C 9/064* (2013.01); *B22C 9/101* (2013.01);

(Continued)

(58) Field of Classification Search

CPC B22C 9/06; B22C 9/064; B22C 9/101; B22C 9/108; B22C 9/24; B22D 15/02; B22D 25/02; B22D 29/001

(Continued)

(56) References Cited

U.S. PATENT DOCUMENTS 2,286,994 A * 6/1942 Nocar ..... B22C 9/101 164/340
2,287,524 A * 6/1942 Jackson ..... B22D 15/02 164/340

(Continued)

FOREIGN PATENT DOCUMENTS

CN 102407317 A 4/2012
CN 203140720 U 8/2013

(Continued)

OTHER PUBLICATIONS

Official Communications dated Nov. 30, 2016 for corresponding Chinese Patent Application No. 201380079867.4.

*Primary Examiner* — Kevin E Yoon
(74) *Attorney, Agent, or Firm* — Carrier Blackman & Associates, P.C.; Joseph P. Carter; Fulchand P. Shende

(57) ABSTRACT

A pair of main molds forming an outer peripheral face of a piston and a pair of side cores forming the pair of cutout recess parts of the piston are prepared, the main mold and the side core are set so as to form a cavity corresponding to the piston, the cavity is charged with molten metal, and when the side core is moved downward and in a direction away from the central axis of the piston so as to carry out mold release from the cutout recess part after the piston within the cavity has solidified, the side core is tilted in a direction in which an upper end thereof approaches the central axis of the piston. Thus, it is possible to release a core smoothly from a cutout recess part without it biting into an inside face of the cutout recess part.

7 Claims, 9 Drawing Sheets

(52) U.S. Cl.
CPC ..... *B22C 9/108* (2013.01); *B22C 9/24* (2013.01); *B22D 25/02* (2013.01); *B22D 29/001* (2013.01); *B22D 30/00* (2013.01); *B22D 45/00* (2013.01)

(58) Field of Classification Search
USPC ..... 164/132, 137, 340, 346
See application file for complete search history.

(56) References Cited

U.S. PATENT DOCUMENTS

| | | | | |
|---|---|---|---|---|
| 2,789,329 | A * | 4/1957 | Peterson | B22D 15/02 164/340 |
| 5,295,804 | A | 3/1994 | Dinnan | |
| 7,213,562 | B2 * | 5/2007 | Schnaitmann | B22C 9/105 123/193.6 |
| 8,235,090 | B2 | 8/2012 | Frank et al. | |
| 8,985,186 | B2 | 3/2015 | Nitsche et al. | |

FOREIGN PATENT DOCUMENTS

| | | | |
|---|---|---|---|
| CN | 103282142 | A | 9/2013 |
| DE | 10142980 | A1 | 3/2003 |
| JP | 1-60743 | U | 4/1989 |
| JP | 3400397 | B2 | 4/2003 |
| JP | 3406266 | B2 | 5/2003 |
| JP | 2003-230950 | A | 8/2003 |
| JP | 2007-253162 | A | 10/2007 |
| JP | 2010-523339 | A | 7/2010 |

* cited by examiner

PISTON CASTING METHOD AND PISTON CASTING DEVICE

TECHNICAL FIELD

The present invention relates to a piston casting method and a piston casting device for casting a piston that includes a columnar ring land part having a top wall, a pair of skirt parts extending downward from opposite end parts, in a diameter direction, of the ring land part, a pair of side wall parts extending from a lower face of the ring land part and linking opposite ends of the two skirt parts to each other, and a pair of pin boss parts formed on these side wall parts, a pair of cutout recess parts being provided in the lower face of the ring land part, an outside face of the side wall part facing the cutout recess parts, and an inside face in a radially outward direction of the cutout recess part being inclined in a direction away from a central axis of the piston in going downward.

BACKGROUND ART

Patent Document 1 below describes such a piston casting method, in which a pair of main molds forming an outer peripheral face of the piston and a pair of side cores forming the pair of cutout recess parts are prepared, the main molds and the cores are set so as to form a cavity corresponding to the piston, the cavity is charged with molten metal, and after the piston within the cavity has solidified, the pair of side cores are made to descend along a linear path in a direction in which they are moved away from a piston center face in going downward, thus carrying out mold release from the cutout recess parts.

RELATED ART DOCUMENTS

Patent Documents

Patent Document 1: Japanese Patent Publication (PCT) No. 2010-523339

SUMMARY OF THE INVENTION

Problems to be Solved by the Invention

However, in the piston casting method described in Patent Document 1, when the side core is released from the cutout recess part of the piston, making the side core descend along the linear path is carried out in order to move the side core linearly along an inside face of the cutout recess part, and by so doing there is a possibility that the side core will bite into an inside face in the radially outward direction of the cutout recess part, and the quality of the piston will be degraded. This is because the side core cannot follow shrinkage due to solidification of the piston, and excessive friction occurs between the side core and the inside face of the cutout recess part when carrying out mold release.

The present invention has been accomplished in light of such circumstances, and it is an object thereof to provide a piston casting method and a piston casting device that enable a core to be smoothly released from a cutout recess part without it biting into an inside face of the cutout recess part.

Means for Solving the Problems

In order to attain the above object, according to a first aspect of the present invention, there is provided a piston casting method for casting a piston comprising a columnar ring land part having a top wall, a pair of skirt parts extending downward from opposite end parts, in a diameter direction, of the ring land part, a pair of side wall parts extending from a lower face of the ring land part and linking opposite ends of the two skirt parts to each other, and a pair of pin boss parts formed on these side wall parts, a pair of cutout recess parts being provided in the lower face of the ring land part, an outside face of the side wall part facing the cutout recess parts, and an inside face in a radially outward direction of the cutout recess part being inclined in a direction away from a central axis of the piston in going downward, characterized in that the method comprises preparing a pair of main molds forming an outer peripheral face of the piston and a pair of side cores forming the pair of cutout recess parts, setting the main mold and the side core so as to form a cavity corresponding to the piston, charging the cavity with molten metal, and when the side core is moved downward and in a direction in which the side core is moved away from the central axis of the piston so as to carry out mold release from the cutout recess part after the piston within the cavity has solidified, tilting the side core in a direction in which an upper end of the side core approaches the central axis of the piston.

Further, according to a second aspect of the present invention, there is provided a piston casting device for casting a piston comprising a columnar ring land part having a top wall, a pair of skirt parts extending downward from opposite end parts, in a diameter direction, of the ring land part, a pair of side wall parts extending from a lower face of the ring land part and linking opposite ends of the two skirt parts to each other, and a pair of pin boss parts formed on these side wall parts, a pair of cutout recess parts being provided in the lower face of the ring land part, an outside face of the side wall part facing the cutout recess parts, and an inside face in a radially outward direction of the cutout recess part being inclined in a direction away from a central axis of the piston in going downward, characterized in that the piston casting device comprises a pair of main molds that open and close along a path in a transverse direction orthogonal to the central axis of the piston in order to form an outer peripheral face of the piston, a guide member having a pair of guide faces that are inclined in a direction away from the central axis of the piston in going downward, a pair of core support bodies having in upper parts a pair of side cores forming the pair of cutout recess parts, and a core raising and lowering device that makes the core support bodies ascend and descend along the pair of guide faces between a set position of the side core where the cutout recess part is to be formed and a mold release position where the side core is released from the cutout recess part, and the core raising and lowering device is arranged so that, when the core support body is made to descend from the set position to the mold release position, the core support body is tilted in a direction in which an upper end of the side core approaches the central axis of the piston.

Furthermore, according to a third aspect of the present invention, in addition to the second aspect, the core raising and lowering device comprises a rod that has the core support body secured to an upper end part thereof, a lever member that is supported on a machine platform via a pivot shaft, extends in a transverse direction, and has an arm having a swing end side relatively pivotably linked to a lower end part of the rod via a linking shaft, an urging mechanism that urges the core support body so as to press the core support body against the guide face, and an actuator that is linked to the lever member and, when operated, pivots the arm so as to move the core support body from the set position to the mold release position by making the rod descend while swinging in a direction in which the angle formed between the rod and the central axis of the piston increases.

Moreover, according to a fourth aspect of the present invention, in addition to the third aspect, the lever member comprises a bell crank comprising a common base portion supported on a lower part of the machine platform via the pivot shaft, a lower arm as the arm extending in a transverse direction from the common base portion, and an upper arm extending upward from the common base portion, and the actuator mounted on the lower part of the machine platform is linked to an extremity of the upper arm.

Further, according to a fifth aspect of the present invention, in addition to the second aspect, each of the guide faces comprises an upper inclined face that has an angle of inclination with respect to the central axis of the piston, and a lower inclined face that is connected to a lower end of the upper inclined face and has an angle of inclination with respect to the central axis that is larger than an angle of inclination of the upper inclined face.

Furthermore, according to a sixth aspect of the present invention, in addition to the third or fourth aspect, a point at which the rod is linked to the arm by the linking shaft can be varied along a longitudinal direction of the arm.

Effects of the Invention

In accordance with the first aspect of the present invention, since when the side core is moved downward and in the direction away from the central axis of the piston so as to release it from the cutout recess part after the piston within the cavity has solidified, the side core is tilted in the direction in which the upper end thereof approaches the central axis of the piston, the side core descends while moving away in the radially inward direction from the inside face in the radially outward direction in which the cutout recess part decreases in diameter due to thermal shrinkage accompanying solidification of the piston, mold release from the cutout recess part can be carried out smoothly, biting into the inside face in the radially outward direction of the cutout recess part does not occur, and the quality of the piston can be improved.

In accordance with the second aspect of the present invention, since when the core raising and lowering device makes the core support body descend from the set position to the mold release position, the core support body is tilted in the direction in which the upper end of the side core approaches the central axis of the piston, the side core descends while moving away in the radially inward direction from the inside face in the radially outward direction in which the cutout recess part decreases in diameter due to thermal shrinkage accompanying solidification of the piston, mold release from the cutout recess part can be carried out smoothly, biting into the inside face in the radially outward direction of the cutout recess part does not occur, and the quality of the piston can be improved.

In accordance with the third aspect of the present invention, when the actuator of the core raising and lowering mechanism is operated in order to release the side core from the cutout recess part of the piston, the linking shaft linking the arm and the rod extends downward and in the direction away from the axis of the piston with the pivot shaft of the arm as the center and moves along the trajectory of the arc, the urging mechanism always pushes the core support body against the guide face of the guide member, and the side core formed integrally with the upper part of the core support body is thereby being tilted while descending so that the upper end thereof approaches the central axis of the piston, thus enabling the side core to be released smoothly from the cutout recess part.

In accordance with the fourth aspect of the present invention, the actuator of the core raising and lowering mechanism is mounted so as to be close to the machine platform, and the core raising and lowering device can be disposed in a compact manner beneath the machine platform.

In accordance with the fifth aspect of the present invention, while the core support body is descending the upper inclined face of the guide face, the side core is disengaged from the cutout recess part of the piston, the core support body subsequently descends the lower inclined face, the speed at which the side core moves away from the central axis of the piston is increased, and even when the outside face of the side wall of the piston is an inclined face formed by extension of the inside face in the radially inward direction of the cutout recess part, since the side core can move away quickly in the radially outward direction from the outside face of the side wall, the piston can be taken out upward at an early stage without interference from the side core, thus contributing to improvement of the productivity.

In accordance with the sixth aspect of the present invention, even when the side core and the core support body are changed accompanying a change in the size of the piston that is to be cast, the draft angle of the cutout recess part, etc., it is possible to quickly cope with the change by moving and adjusting the point at which the rod is linked to the arm by means of the linking shaft along the longitudinal direction of the arm.

EXPLANATION OF REFERENCE NUMERALS AND SYMBOLS

Figure 1:
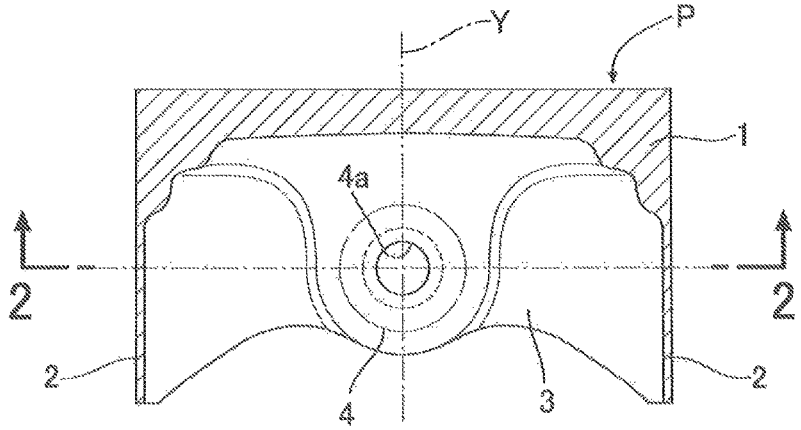
FIG. 1 is a sectional side view (sectional view along line 1-1 in FIG. 2) of a piston. (first embodiment)
Figure 2:
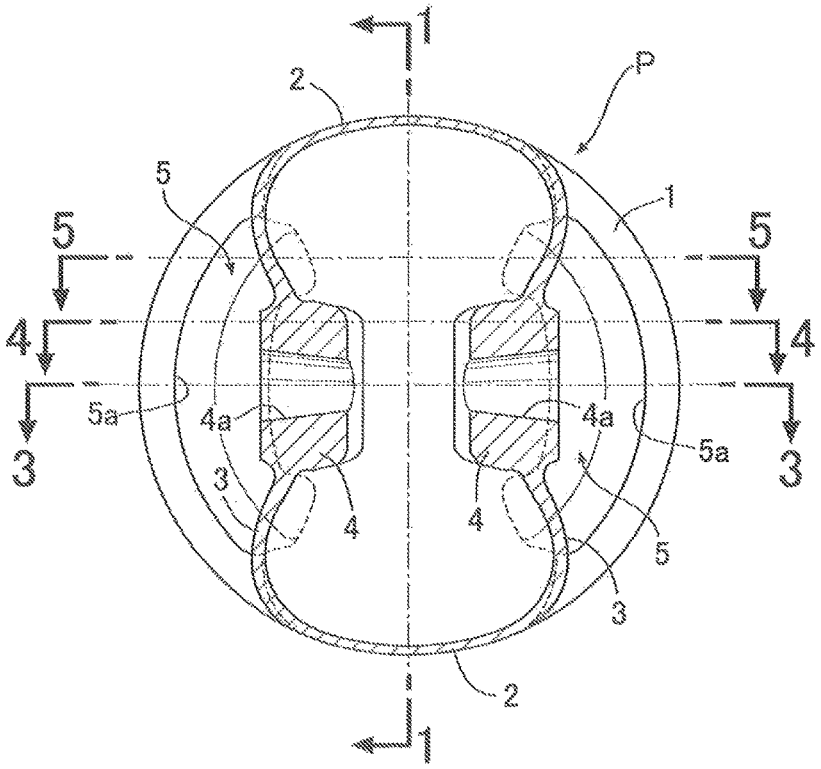
FIG. 2 is a sectional view along line 2-2 in FIG. 1. (first embodiment)
Figure 3:
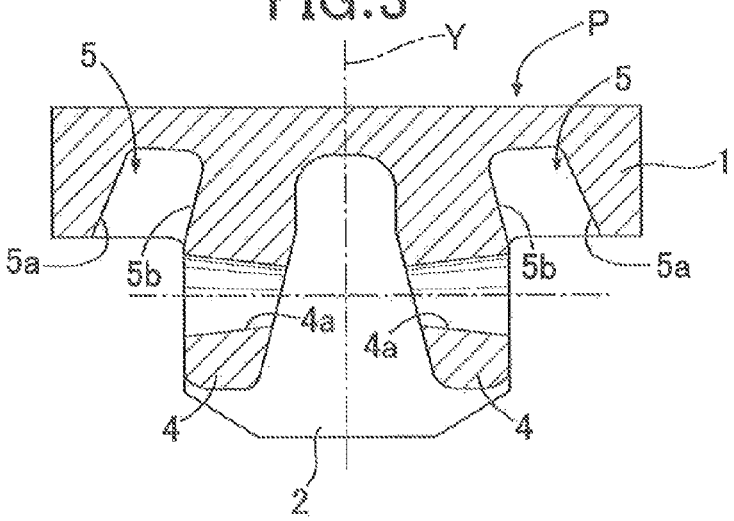
FIG. 3 is a sectional view along line 3-3 in FIG. 2. (first embodiment)
Figure 4:
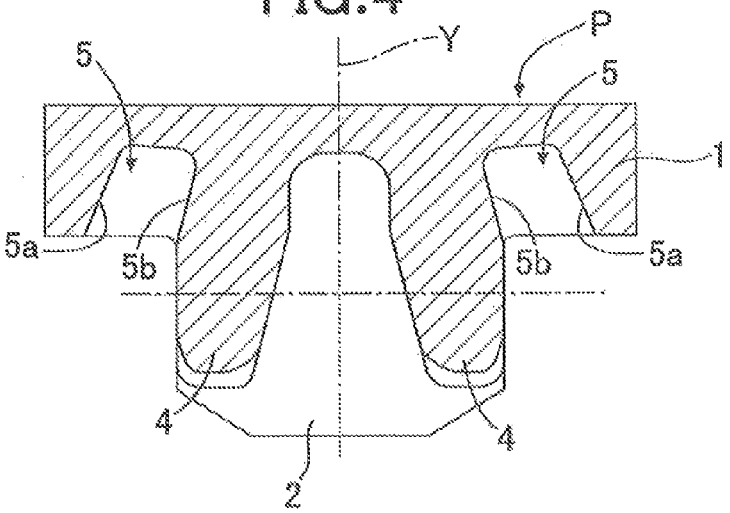
FIG. 4 is a sectional view along line 4-4 in FIG. 2. (first embodiment)
Figure 5:
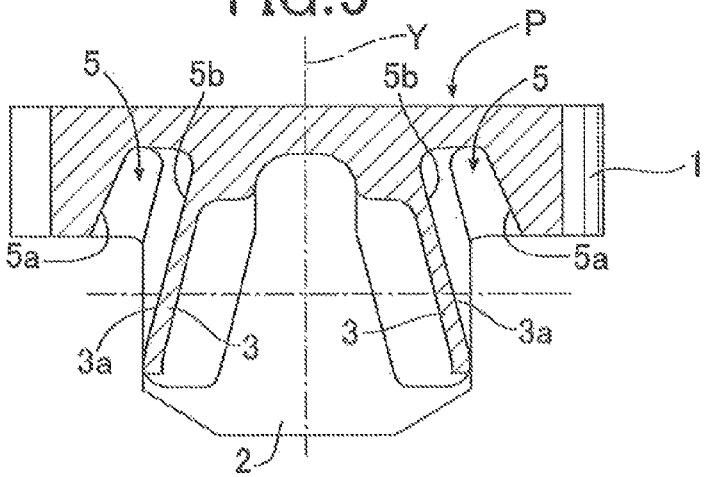
FIG. 5 is a sectional view along line 5-5 in FIG. 2. (first embodiment)

P Piston
M Piston casting device
Y Piston central axis

1 Ring land part
2 Skirt part
3 Side wall part
4 Pin boss part
5 Cutout recess part
5*a* Inside face in radially outward direction
5*b* Inside face in radially inward direction
10 Machine platform
11 Cavity
13 Main mold
16 Side core
23 Actuator (fifth actuator)
25 Guide member
27 Guide face
27*a* Upper inclined face
27*b* Lower inclined face
29 Core support body
30 Core raising and lowering device
31 Rod
32 Bracket
33 Pivot shaft
34 Lever member, bell crank
34*a* Common base portion
34*b* Arm, lower arm
34*c* Upper arm
37 Linking shaft (first linking shaft)
39 Urging mechanism

MODE FOR CARRYING OUT THE INVENTION

An embodiment of the present invention is explained below by reference to the attached drawings.

First Embodiment

First, the structure of a piston for an internal combustion engine that is to be cast is explained by reference to FIG. 1 to FIG. 5. A piston P for an internal combustion engine includes a columnar ring land part 1 having a top wall, a pair of front and rear skirt parts 2 extending downward from opposite end parts in the diameter direction of the ring land part 1, a pair of left and right side wall parts 3 extending from a lower face of the ring land part 1 and linking opposite ends of the two skirt parts 2 to each other, and a pair of pin boss parts 4 formed on the side wall parts 3, the pair of pin boss parts 4 having pin holes 4*a* that are arranged coaxially, a pair of left and right arc-shaped cutout recess parts 5 being provided in the lower face of the ring land part 1, and part of the side wall part 3 facing the arc-shaped cutout recess part 5. Inside faces 5*a* and 5*b* in radially outward and inward directions of the cutout recess part 5 are both inclined faces that run in a direction in which they move away from a central axis Y of the piston P in going downward, and outside faces 3*a* of the side wall part 3 that are arranged with the pin boss part 4 interposed therebetween are faces that extend from the inside face 5*b*. Therefore, the outside face 3*a* is also inclined in a direction in which it moves away from the central axis Y of the piston P in going downward.

A piston casting device M for casting the piston P is now explained by means of FIG. 6 to FIG. 11.

Figure 6:
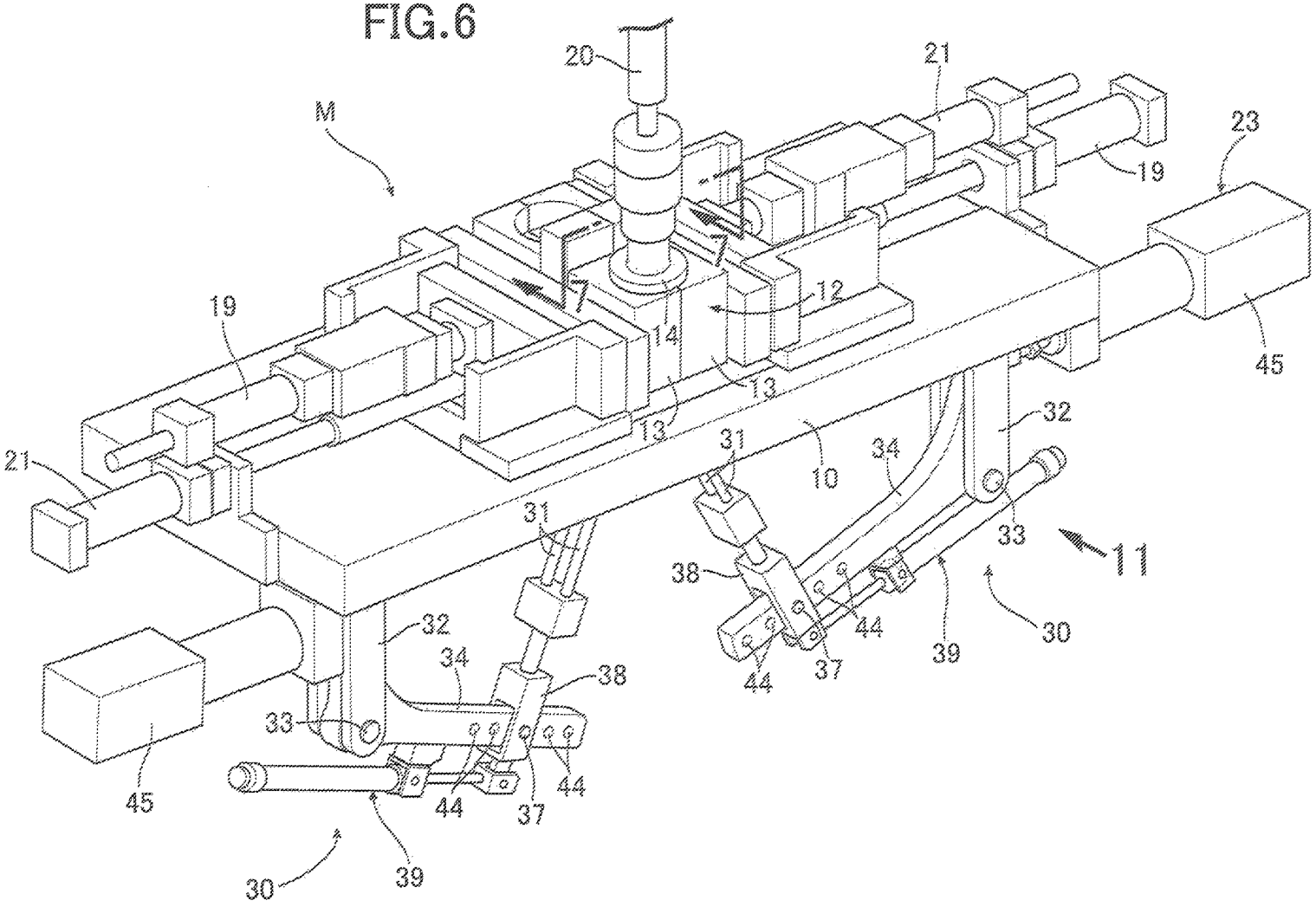
FIG. 6 is an overall perspective view of a piston casting device. (first embodiment)
Figure 7:
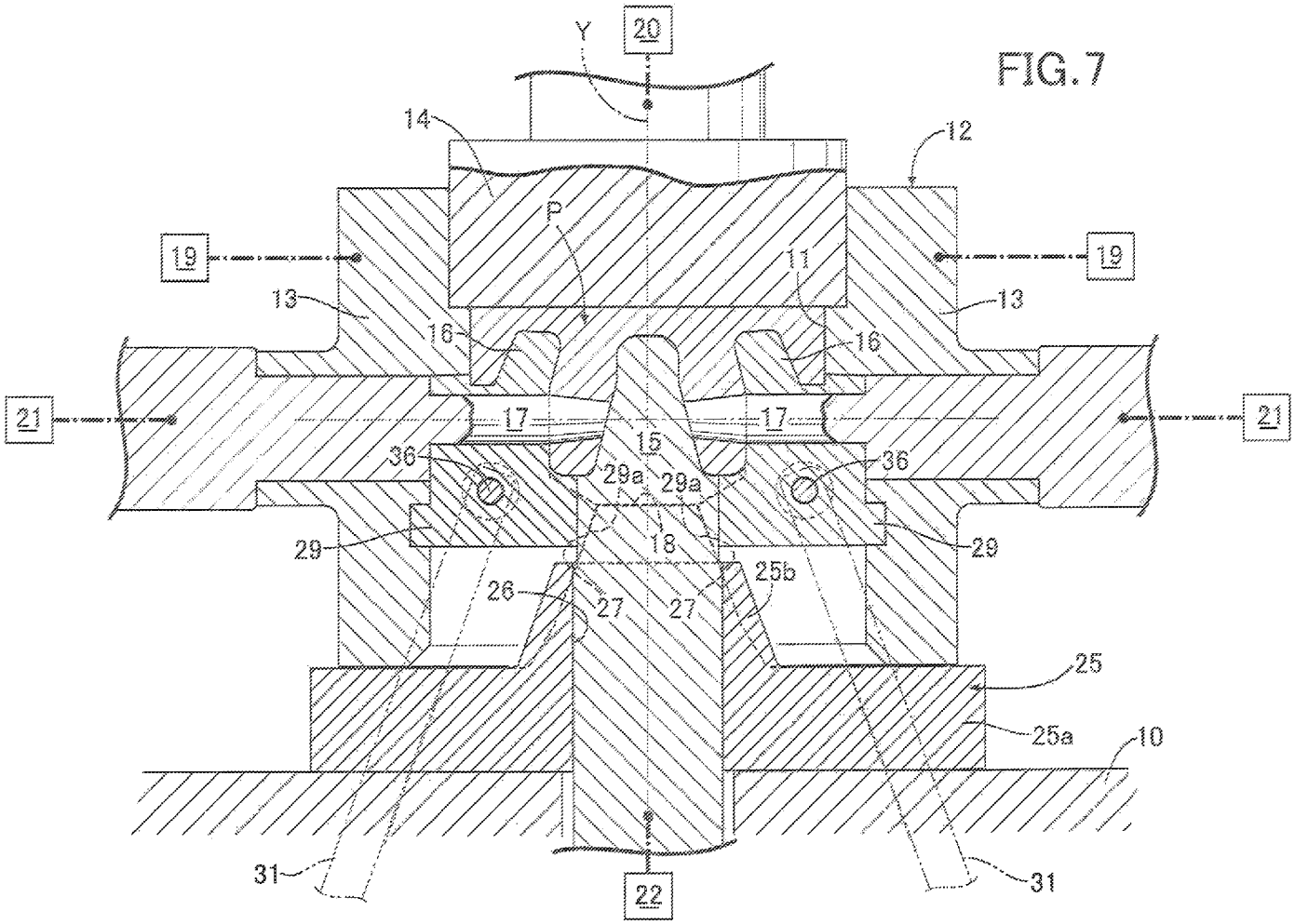
FIG. 7 is an enlarged sectional view along line 7-7 in FIG. 6. (first embodiment)

In FIG. 6 and FIG. 7, the structure of the piston casting device M is substantially symmetrical in the left and right direction on opposite sides of the central axis Y of the piston P that is to be cast.

Provided on a machine platform 10 is a die 12 for defining a cavity 11 corresponding to the shape of the piston P. This die 12 includes a pair of left and right main molds 13 forming an outer peripheral face of the piston P, an upper mold 14 forming the top wall of the piston P, a center core 15 forming a piston P hollow part that is surrounded by the skirt part 2 and the side wall part 3, a pair of left and right side cores 16 forming the left and right cutout recess parts 5 and the outside face 3*a* of the side wall part 3 of the piston P, a pair of left and right core pins 17 capable of extending through the side core 16 in a transverse direction so as to form the left and right pin holes 4*a*, and a workpiece receiving part 18 forming a lower end face of the skirt part 2.

The left and right main molds 13 are opened and closed by means of a pair of left and right first actuators 19 mounted on the machine platform 10, the upper mold 14 is made to ascend and descend by means of a second actuator 20 mounted on a fixed beam (not illustrated), the left and right core pins 17 are opened and closed by means of a third actuator 21 mounted on the machine platform 10, and the center core 15 is made to ascend and descend by means of a fourth actuator 22 mounted on a support post (not illustrated) supporting the machine platform 10 from below.

Figure 8:
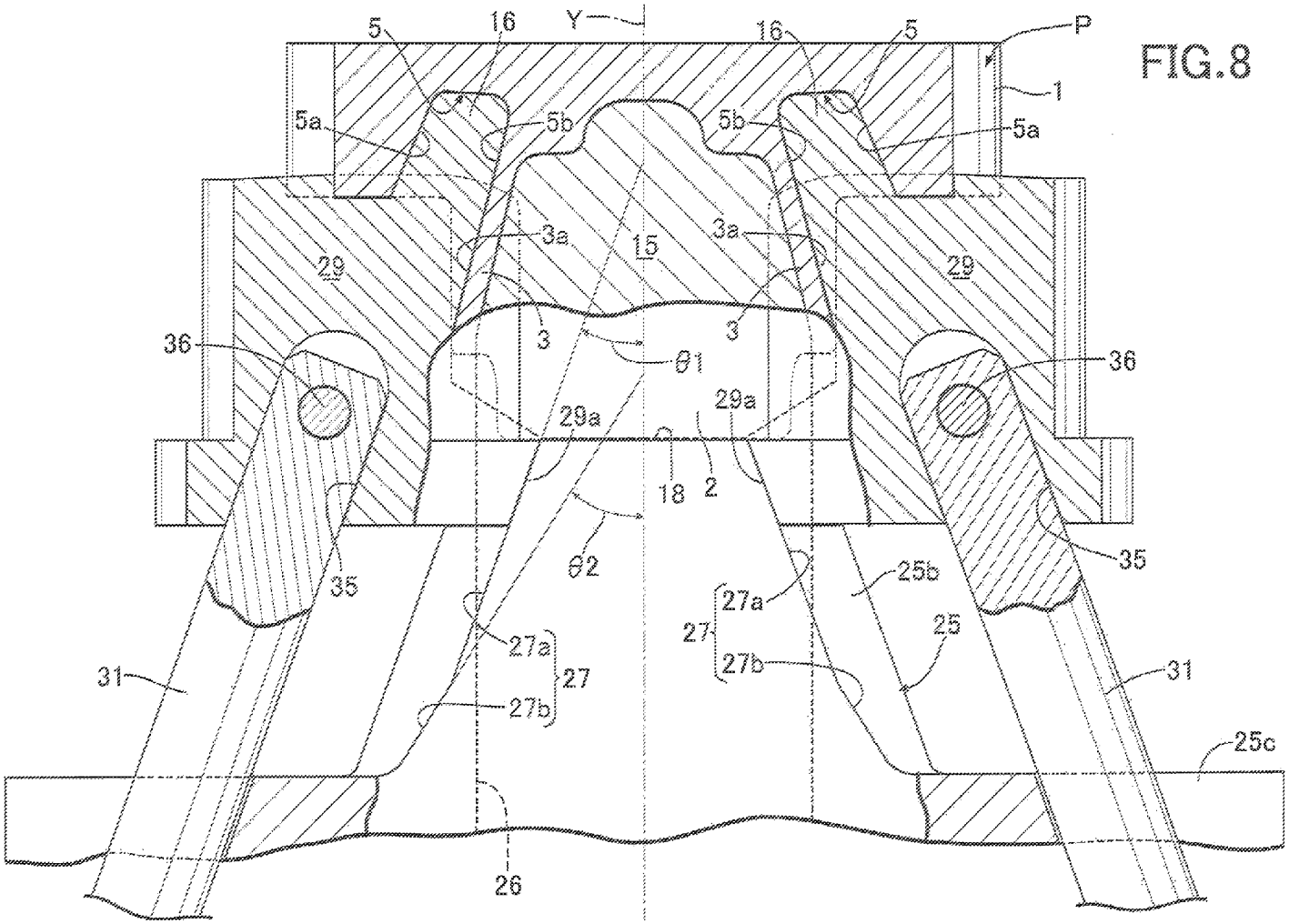
FIG. 8 is a front view of the area around a guide member in the piston casting device. (first embodiment)
Figure 9:
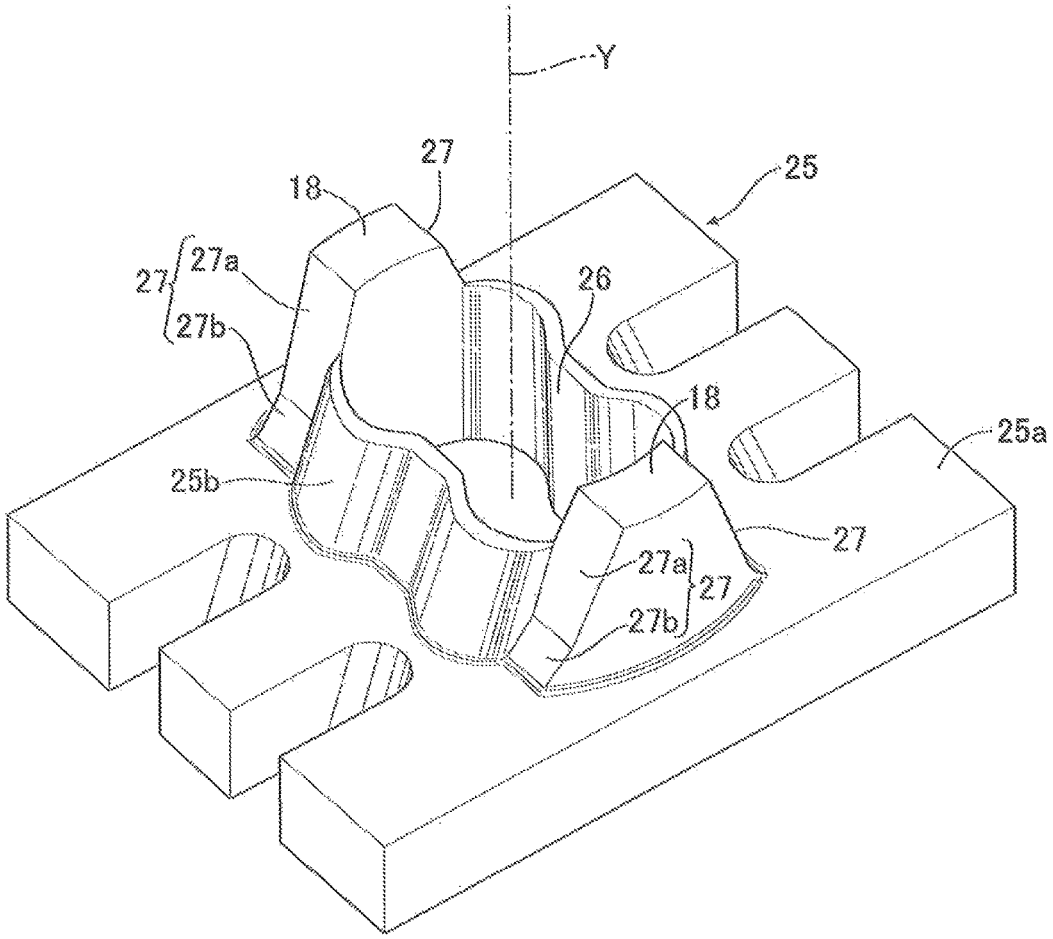
FIG. 9 is a perspective view of the guide member. (first embodiment)
Figure 10:
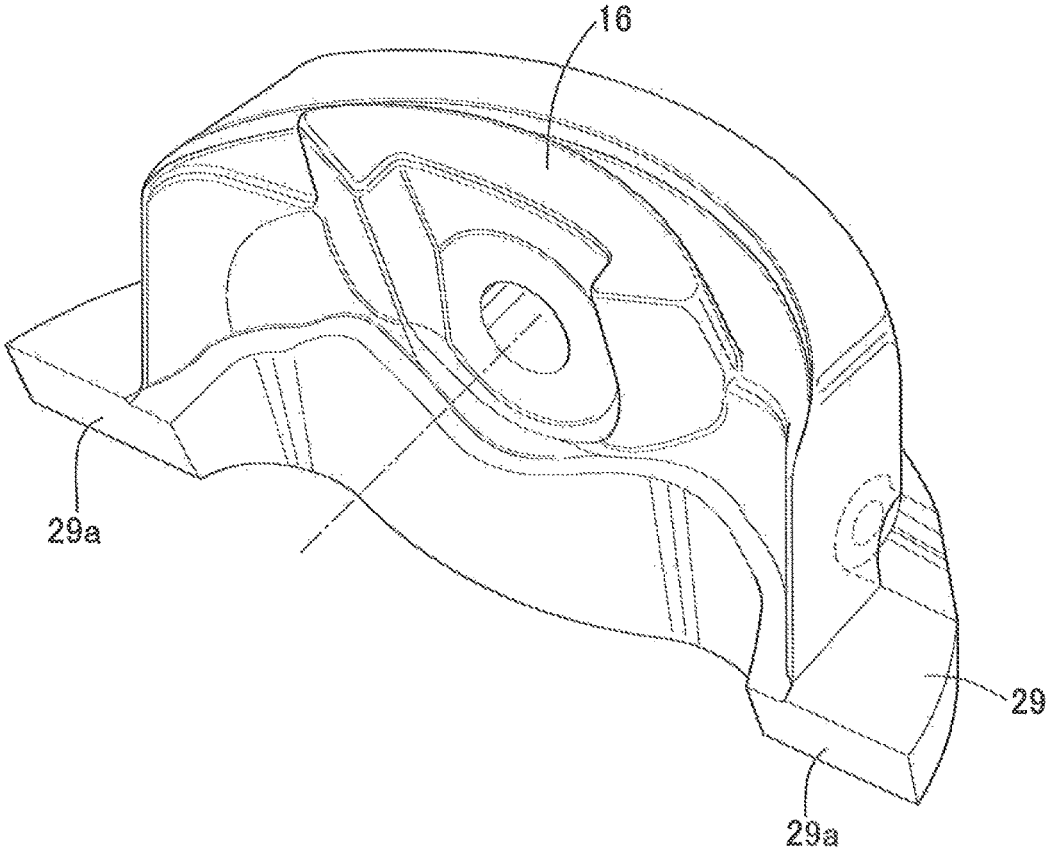
FIG. 10 is a perspective view of a side core. (first embodiment)

As shown in FIG. 7 to FIG. 9, a guide member 25 is placed on the machine platform 10. This guide member 25 is formed from a base portion 25*a* fixed to the machine platform 10 and a tower portion 25*b* rising from the top of the base portion 25*a*, a guide hole 26 for guiding the center core 15 in a freely rising and falling manner is formed in a center part of the tower portion 25*b*, and a pair of front and rear workpiece receiving parts 18 are formed on an upper end face of the tower portion 25*b*. Moreover, a pair of front and rear guide faces 27 are formed on each of left and right outside faces of the tower portion 25*b*. Each guide face 27 is an inclined face that is inclined in a direction such that it moves away from the central axis Y of the piston P in going downward, and this guide face 27 is formed from an upper inclined face 27*a* that has an angle of inclination with respect to the central axis Y of the piston P of $\theta 1$, which is substantially equal to the angle of inclination of the inside face 5*a* in the radially outward direction of the cutout recess part 5 of the piston P, and a lower inclined face 27*b* that is connected to the lower end of the upper inclined face 27*a* and has an angle of inclination with respect to the central axis Y of the piston P of $\theta 2$, which is larger than said $\theta 1$.

A pair of left and right core support bodies 29 are disposed on left and right sides of the tower portion 25*b*, and the pair of side cores 16 are formed integrally with and supported on upper parts of these core support bodies 29. Each core support body 29 has a sliding surface 29*a* that slides vertically along the corresponding guide face 27; each core support body 29 ascends and descends, along the corresponding guide face 27, between a set position in which the side core 16 is set at a position where the cutout recess part 5 is to be formed and a mold release position in which the side core 16 is sufficiently moved downward away from the cutout recess part 5, and a core raising and lowering device 30 that makes the core support body 29 ascend and descend as above is linked to the core support body 29.

Figure 11:
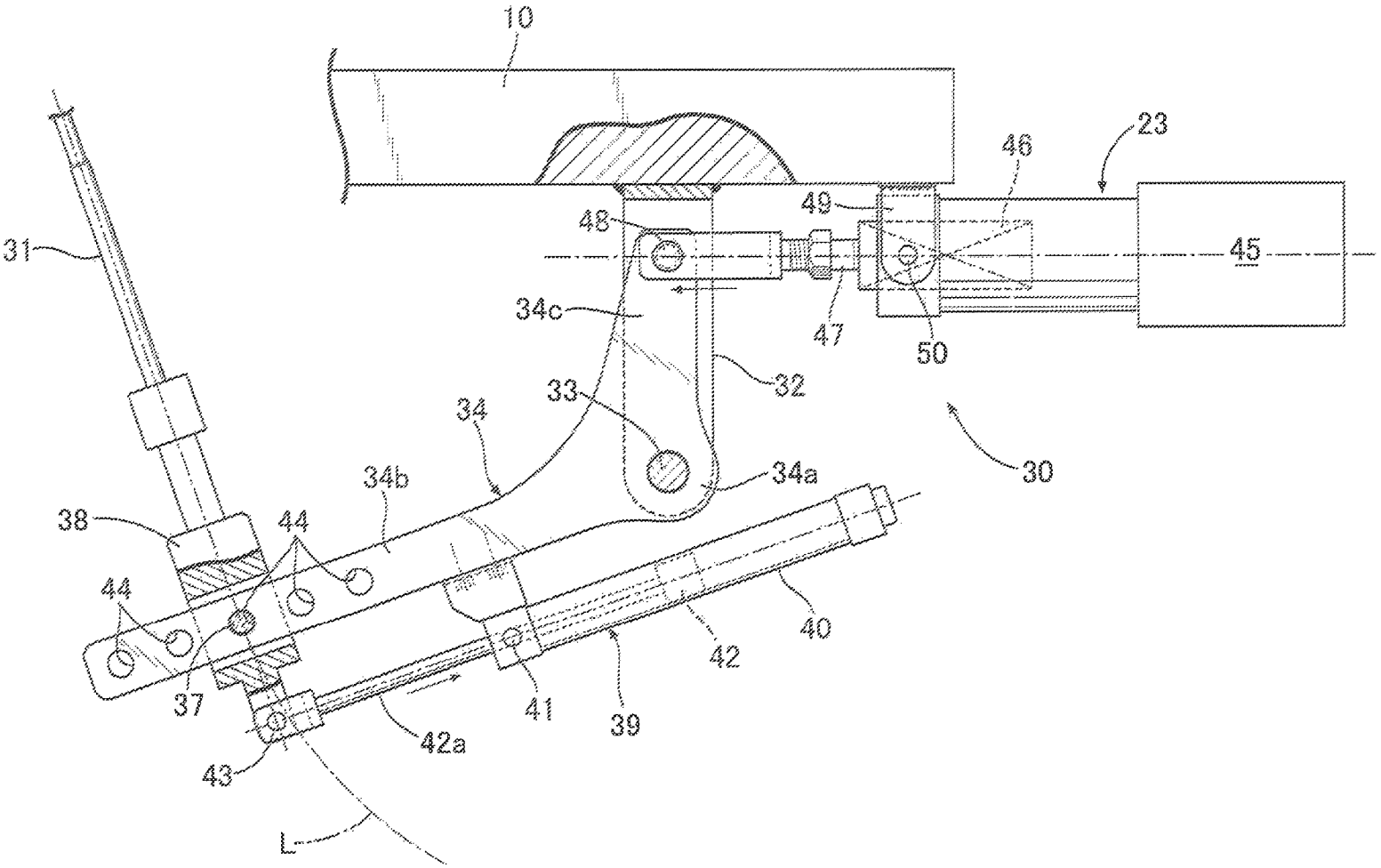
FIG. 11 is a view in the direction of arrow 11 in FIG. 6. (first embodiment)

In FIG. 8 and FIG. 11, the core raising and lowering device 30 includes a pair of front and rear rods 31 having the core support body 29 integrally linked to and supported on an upper end part thereof, and a bell crank 34 swingably supported via a pivot shaft 33 on a bracket 32 fixed to the machine platform 10 and extending downward. The core support body 29 has a pair of front and rear link holes 35 into which upper end parts of the pair of front and rear rods 31 are fitted, and the core support body 29 is secured to the rod 31 by inserting and fixing a link pin 36 through the upper end part of the rod 31 fitted into the link hole 35 and the core support body 29 in the manner of a skewer.

The bell crank 34 is formed from a common base portion 34*a* having the pivot shaft 33 supported on the bracket 32, a lower arm 34*b* extending in a transverse direction from the common base portion 34*a* toward the central axis Y of the piston P, and an upper arm 34*c* rising from the base portion 34*a*, a lower end part of the rod 31 being secured to a rod support body 38 relatively pivotably linked to the swing end of the lower arm 34*b* via a first linking shaft 37. A plurality of link holes 44 arranged in the longitudinal direction of the lower arm 34*b* are bored in a swing end part of the lower arm 34*b*, and selectively linking the first linking shaft 37 to one of the link holes 44 enables the point at which the rod 31 is linked to the lower arm 34*b* by means of the first linking shaft 37 to be adjusted along the longitudinal direction of the lower arm 34*b*.

An urging mechanism 39 urging the sliding surface 29*a* of the core support body 29 so as to press it against the guide face 27 of the guide member 25 is mounted on the lower arm 34*b*. This urging mechanism 39 is formed from a pneumatic damper, which includes a cylinder 40 pivotably mounted on the lower arm 34*b* via a support shaft 41 and a piston 42 housed in the interior of the cylinder 40, the extremity of a piston rod 42*a* connected to the piston 42 is linked to an end part, on the side opposite to the rod 31, of the rod support body 38 via a link pin 43, and the pneumatic pressure of the cylinder 40 acts on the piston 42 so as to draw the piston rod 42*a* into the cylinder 40. In this way the pneumatic pressure within the cylinder 40 is transmitted to the rod support body 38 and the rod 31 via the piston rod 42*a*, and the sliding surface 29*a* of the core support body 29 is always pressed against the guide face 27 of the guide member 25.

An operating shaft 47 is relatively pivotably linked to the extremity of the upper arm 34*c* via a second linking shaft 48, and a fifth actuator 23 that pushes and pulls the operating shaft 47 in the left-and-right direction is linked to the operating shaft 47. In the illustrated example, this fifth actuator 23 includes an electric motor 45 supported via a support shaft 50 on a bracket 49 projectingly provided on a lower face of the machine platform 10, and a rotor shaft of this electric motor 45 is linked to the operating shaft 47 via a ball screw mechanism 46. Rotating the electric motor 45 forward enables the operating shaft 47 to be pushed out and the rod 31 to be made to descend together with the core support body 29 via the bell crank 34, and rotating the electric motor 45 in reverse enables the operating shaft 47 to be pulled in and the rod 31 to be made to ascend together with the core support body 29 via the bell crank 34. The set position and the mold release position of the core support body 29 are restricted by controlling rotation of the electric motor 45.

The operation of this embodiment is now explained.

When casting the piston P, first the cavity 11 is formed by closing the die 12, which includes the main mold 13, the upper mold 14, the center core 15, the core pin 17, the side core 16, etc. In this process, each of the left and right core support bodies 29 is disposed at the set position, and each side core 16 is held in order to form the cutout recess part 5 of the piston P.

Molten metal is poured into the cavity 11 to thus mold the piston P, and after the piston P has solidified, the main mold 13, the upper mold 14, the center core 15, and the core pin 17 are removed from the piston P so as to carry out mold release. As a result, the piston P remains on the workpiece receiving part 18 of the guide member 25.

Here, when the electric motor 45 is rotated forward so as to push out the operating shaft 47, the lower arm 34*b* of the bell crank 34 swings downward from a substantially horizontal position, and the first linking shaft 37 linking the lower arm 34*b* and the rod support body 38 extends, with the pivot shaft 33 of the bell crank 34 as the center, downward and in a direction in which it moves away from the central axis Y of the piston P and moves along a trajectory L of an arc, thus driving the rod support body 38.

Figure 12:
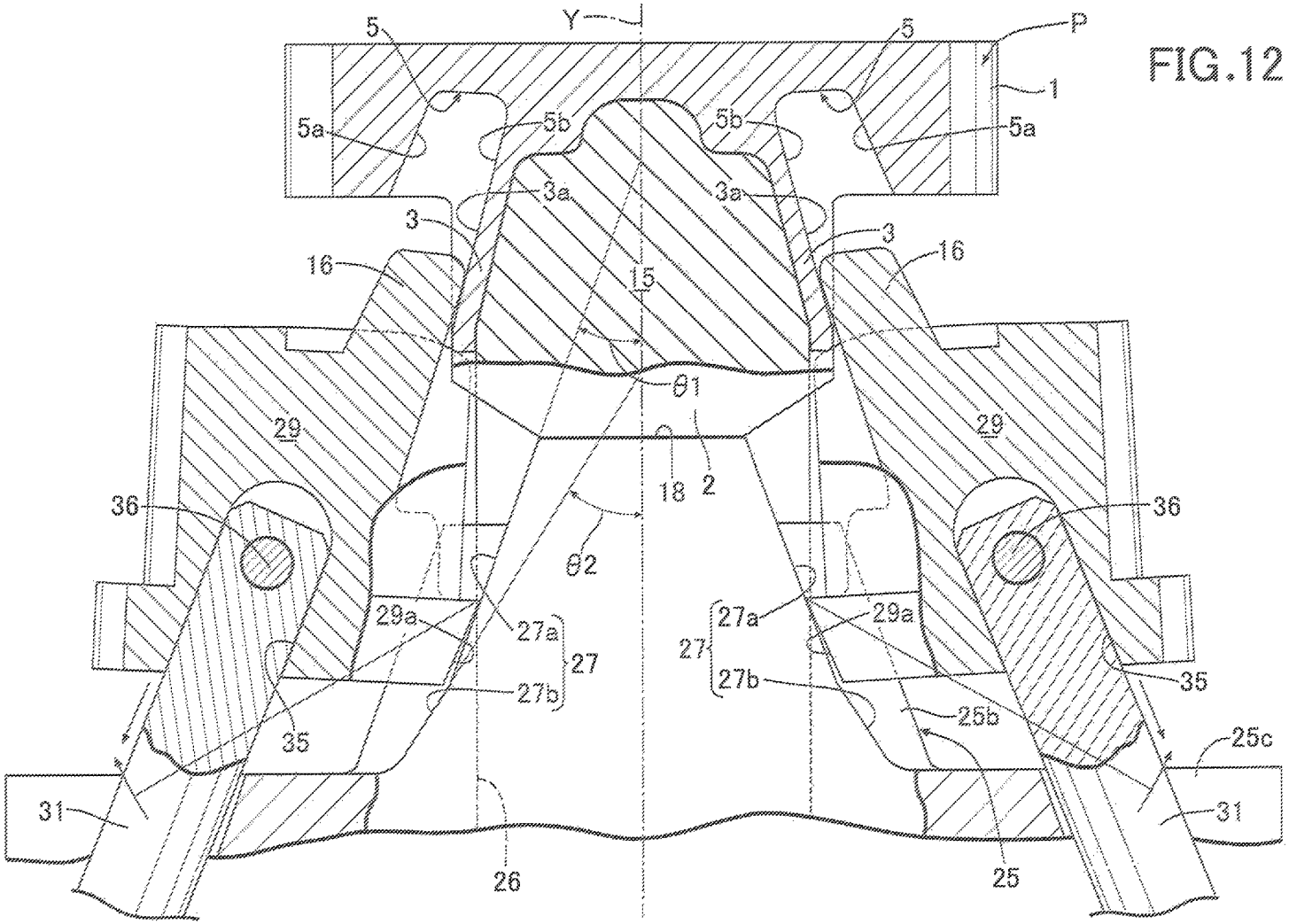
FIG. 12 is a diagram, corresponding to FIG. 8, for explaining the operation. (first embodiment)

On the other hand, since the urging mechanism 39, that is, the pneumatic damper, always pushes the guide face 27 of the core support body 29 against the guide face 27 of the guide member 25 via the rod 31, accompanying the advance of the first linking shaft 37 along the trajectory L, the core support body 29 descends while making the sliding surface 29*a* slide on the guide face 27, and at the same time the lower part thereof starts tilting in a direction in which it moves away from the central axis Y of the piston P with the upper end of the sliding surface 29*a* as a fulcrum (see FIG. 12). As a result, the side core 16 formed integrally with the upper part of the core support body 29 starts tilting while descending so that the upper end thereof approaches the central axis Y of the piston P.

Therefore, the side core 16 descends while moving toward the radially inward direction away from the inside face 5*a* in the radially outward direction of the cutout recess part 5, which reduces in diameter due to thermal shrinkage accompanying solidification of the piston P, the side core 16 can be smoothly released from the cutout recess part 5, and there is no biting into the inside face 5*a* in the radially outward direction of the cutout recess part 5, thus contributing to improvement of the quality of the piston P.

While the core support body 29 is descending on the upper inclined face 27*a* of the guide face 27 the side core 16 is disengaged from the cutout recess part 5 of the piston P, and the core support body 29 subsequently starts descending on the lower inclined face 27*b*; since the angle of inclination θ2 of the lower inclined face 27*b* with respect to the central axis Y of the piston P is larger than the θ1 of the upper inclined face 27*a*, due to the core support body 29 descending on the lower inclined face 27*b*, the speed at which the side core 16 moves away from the central axis Y of the piston P is increased. Therefore, even when the outside face 3*a* of the side wall part 3 of the piston P is an inclined face formed by extension of the inside face 5*b* in the radially inward direction of the cutout recess part 5, since the side core 16 can move away quickly in the radially outward direction from the outside face 3*a* of the side wall part 3, the piston P on the workpiece receiving part 18 can be taken out upward at an early stage without interference from the side core 16, thus contributing to improvement of the productivity.

Furthermore, the core raising and lowering device 30 of the piston casting device M is formed from the rod 31 having the core support body 29 secured to the upper end part, the bell crank 34, which includes the common base portion 34*a* supported on the bracket 32 via the pivot shaft 33, the lower arm 34*b* extending in the transverse direction from the common base portion 34*a* and having the extremity relatively pivotably linked to the rod 31, and the upper arm 34*c* extending upward from the base portion 34*a*, the urging mechanism 39 urging the core support body 29 so as to press it against the guide face 27, and the fifth actuator 23 linked to the extremity of the upper arm 34*c* of the bell crank 34; the fifth actuator 23 is thereby mounted in the proximity of the machine platform 10, and it is thus possible to dispose the core raising and lowering device 30 beneath the machine platform 10 in a compact manner.

Moreover, since the point at which the rod 31 is linked to the lower arm 34*b* by means of the linking shaft 37 can be adjusted along the longitudinal direction of the lower arm 34*b*, even when the side core 16 and the core support body 29 are changed accompanying a change in the size of the piston P that is to be cast, the draft angle of the cutout recess part 5, etc., it is possible to quickly cope with the change by moving and adjusting the point at which the rod is linked to the arm by means of the linking shaft along the longitudinal direction of the arm.

The present invention is not limited to the above embodiment and may be modified in a variety of ways as long as the modifications do not depart from the spirit and scope thereof. For example, as the urging mechanism 39, a spring type damper may be used. Furthermore, the number of rods 31 linked to the guide member 25 may be one. Moreover, instead of the plurality of link holes 44 of the lower arm 34*b*, an elongated hole extending in the longitudinal direction of the lower arm 24*b* may be employed.

The invention claimed is:

1. A piston casting method for casting a piston comprising a columnar ring land part having a top wall, a pair of skirt parts extending downward from opposite end parts, in a diameter direction, of the ring land part, a pair of side wall parts extending from a lower face of the ring land part and linking opposite ends of the two skirt parts to each other, and a pair of pin boss parts formed on these side wall parts, a pair of cutout recess parts being provided in the lower face of the ring land part, an outside face of the side wall part facing the cutout recess parts, and an inside face in a radially outward direction of the cutout recess part being inclined in a direction away from a central axis of the piston in going downward, wherein the method comprises preparing a pair of main molds forming an outer peripheral face of the piston and a pair of side cores forming the pair of cutout recess parts, setting the main mold and the side core so as to form a cavity corresponding to the piston, charging the cavity with molten metal, and when the side core is moved downward and in a direction in which the side core is moved away from the central axis of the piston so as to carry out mold release from the cutout recess part after the piston within the cavity has solidified, tilting the side core in a direction in which an upper end of the side core approaches the central axis of the piston.

2. A piston casting device for casting a piston comprising a columnar ring land part having a top wall, a pair of skirt parts extending downward from opposite end parts, in a diameter direction, of the ring land part, a pair of side wall parts extending from a lower face of the ring land part and linking opposite ends of the two skirt parts to each other, and a pair of pin boss parts formed on these side wall parts, a pair of cutout recess parts being provided in the lower face of the ring land part, an outside face of the side wall part facing the cutout recess parts, and an inside face in a radially outward direction of the cutout recess part being inclined in a direction away from a central axis of the piston in going downward, wherein the piston casting device comprises a pair of main molds that open and close along a path in a transverse direction orthogonal to the central axis of the piston in order to form an outer peripheral face of the piston, a guide member having a pair of guide faces that are inclined in a direction away from the central axis of the piston in going downward, a pair of core support bodies having in upper parts a pair of side cores forming the pair of cutout recess parts, and a core raising and lowering device that makes the core support bodies ascend and descend along the pair of guide faces between a set position of the side core where the cutout recess part is to be formed and a mold release position where the side core is released from the cutout recess part, and the core raising and lowering device is arranged so that, when the core support body is made to descend from the set position to the mold release position, the core support body is tilted in a direction in which an upper end of the side core approaches the central axis of the piston.

3. The piston casting device according to claim 2, wherein the core raising and lowering device comprises a rod that has the core support body secured to an upper end part thereof, a lever member that is supported on a machine platform via a pivot shaft, extends in a transverse direction, and has an arm having a swing end side relatively pivotably linked to a lower end part of the rod via a linking shaft, an urging mechanism that urges the core support body so as to press the core support body against the guide face, and an actuator that is linked to the lever member and, when operated, pivots the arm so as to move the core support body from the set position to the mold release position by making the rod descend while swinging in a direction in which the angle formed between the rod and the central axis of the piston increases.

4. The piston casting device according to claim 3, wherein the lever member comprises a bell crank comprising a common base portion supported on a lower part of the machine platform via the pivot shaft, a lower arm as the arm extending in a transverse direction from the common base portion, and an upper arm extending upward from the common base portion, and the actuator mounted on the lower part of the machine platform is linked to an extremity of the upper arm.

5. The piston casting device according to claim 4, wherein a point at which the rod is linked to the arm by the linking shaft can be varied along a longitudinal direction of the arm.

6. The piston casting device according to claim 3, wherein a point at which the rod is linked to the arm by the linking shaft can be varied along a longitudinal direction of the arm.

7. The piston casting device according to claim 2, wherein each of the guide faces comprises an upper inclined face that has an angle of inclination with respect to the central axis of the piston, and a lower inclined face that is connected to a lower end of the upper inclined face and has an angle of inclination with respect to the central axis that is larger than an angle of inclination of the upper inclined face.

* * * * *